US008130173B2

(12) United States Patent
Deane et al.

(10) Patent No.: US 8,130,173 B2
(45) Date of Patent: Mar. 6, 2012

(54) ACTIVE MATRIX ELECTROLUMINESCENT DISPLAY DEVICES

(75) Inventors: Steven C. Deane, Redhill (GB); David A. Fish, Haywards Heath (GB); Alan G. Knapp, Crawley (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 1457 days.

(21) Appl. No.: 10/543,198

(22) PCT Filed: Jan. 20, 2004

(86) PCT No.: PCT/IB2004/000158

§ 371 (c)(1),
(2), (4) Date: Jul. 22, 2005

(87) PCT Pub. No.: WO2004/066250

PCT Pub. Date: Aug. 5, 2004

(65) Prior Publication Data

US 2006/0097965 A1 May 11, 2006

(30) Foreign Application Priority Data

Jan. 24, 2003 (GB) ..... 0301623.5

(51) Int. Cl.
*G09G 3/30* (2006.01)

(52) U.S. Cl. ..... 345/76; 345/82

(58) Field of Classification Search ..... 345/76; 438/200; 315/169.3

See application file for complete search history.

(56) References Cited

U.S. PATENT DOCUMENTS

| | | | | |
|---|---|---|---|---|
| 7,113,154 | B1 * | 9/2006 | Inukai | 345/76 |
| 2002/0047555 | A1 * | 4/2002 | Inukai | 315/169.3 |
| 2003/0040149 | A1 * | 2/2003 | Kasai | 438/200 |
| 2004/0046719 | A1 * | 3/2004 | Wang et al. | 345/82 |
| 2007/0236430 | A1 * | 10/2007 | Fish | 345/82 |

FOREIGN PATENT DOCUMENTS

| | | | |
|---|---|---|---|
| CN | 1474371 | A | 2/2004 |
| EP | 0717446 | A2 | 6/1996 |
| EP | 1296310 | A1 | 3/2003 |
| WO | WO9636959 | A2 | 11/1996 |
| WO | WO0217289 | A1 | 2/2002 |

OTHER PUBLICATIONS

S. R. Forrest, et al; Electrohposphorescent Organic Light Emitting Devices; 52.1 SID 02 Digest, May 2002, p. 1357, USA. J. P. J. Markham, et al; Highly Efficient Solution-Processible Dendrimer LEDs, L-8 SID 02 Digest, May 2002, p. 1032, UK.

* cited by examiner

*Primary Examiner* — Quan-Zhen Wang
*Assistant Examiner* — Yuk Chow

(57) ABSTRACT

Each pixel of an active matrix electroluminescent display device has a first amorphous silicon drive transistor for intermittently driving a current through the display element and a second amorphous silicon drive transistor for intermittently driving a current through the display element. The aging effect of amorphous silicon TFTs can be reduced by sharing the driving of the display element between two drive transistors. Providing a duty cycle reduces the on-time for each drive transistor, but also provides a period during which there can be some recovery of the TFT characteristics.

25 Claims, 11 Drawing Sheets

ACTIVE MATRIX ELECTROLUMINESCENT DISPLAY DEVICES

This invention relates to electroluminescent display devices, particularly active matrix display devices having thin film switching transistors associated with each pixel.

Matrix display devices employing electroluminescent, light-emitting, display elements are well known. The display elements may comprise organic thin film electroluminescent elements, for example using polymer materials, or else light emitting diodes (LEDs) using traditional III-V semiconductor compounds. Recent developments in organic electroluminescent materials, particularly polymer materials, have demonstrated their ability to be used practically for video display devices. These materials typically comprise one or more layers of a semiconducting conjugated polymer sandwiched between a pair of electrodes, one of which is transparent and the other of which is of a material suitable for injecting holes or electrons into the polymer layer. Organic electroluminescent materials exhibit diode-like I-V properties, so that they are capable of providing both a display function and a switching function, and can therefore be used in passive type displays. Alternatively, these materials may be used for active matrix display devices, with each pixel comprising a display element and a switching device for controlling the current through the display element.

Display devices of this type have current-driven display elements, so that a conventional, analogue drive scheme involves supplying a controllable current to the display element. It is known to provide a current source transistor as part of the pixel configuration, with the gate voltage supplied to the current source transistor determining the current through the display element. A storage capacitor holds the gate voltage after the addressing phase.

FIG. 1 shows a known pixel circuit for an active matrix addressed electroluminescent display device. The display device comprises a panel having a row and column matrix array of regularly-spaced pixels, denoted by the blocks 1 and comprising electroluminescent display elements 2 together with associated switching means, located at the intersections between crossing sets of row (selection) and column (data) address conductors 4 and 6. Only a few pixels are shown in the Figure for simplicity. In practice there may be several hundred rows and columns of pixels. The pixels 1 are addressed via the sets of row and column address conductors by a peripheral drive circuit comprising a row, scanning, driver circuit 8 and a column, data, driver circuit 9 connected to the ends of the respective sets of conductors.

The electroluminescent display element 2 comprises an organic light emitting diode, represented here as a diode element (LED) and comprising a pair of electrodes between which one or more active layers of organic electroluminescent material is sandwiched. The display elements of the array are carried together with the associated active matrix circuitry on one side of an insulating support. Either the cathodes or the anodes of the display elements are formed of transparent conductive material. The support is of transparent material such as glass and the electrodes of the display elements 2 closest to the substrate may consist of a transparent conductive material such as ITO so that light generated by the electroluminescent layer is transmitted through these electrodes and the support so as to be visible to a viewer at the other side of the support. Typically, the thickness of the organic electroluminescent material layer is between 100 nm and 200 nm. Typical examples of suitable organic electroluminescent materials which can be used for the elements 2 are known and described in EP-A-0 717446. Conjugated polymer materials as described in WO96/36959 can also be used.

FIG. 2 shows in simplified schematic form a known pixel and drive circuitry arrangement for providing voltage-programmed operation. Each pixel 1 comprises the EL display element 2 and associated driver circuitry. The driver circuitry has an address transistor 16 which is turned on by a row address pulse on the row conductor 4. When the address transistor 16 is turned on, a voltage on the column conductor 6 can pass to the remainder of the pixel. In particular, the address transistor 16 supplies the column conductor voltage to a current source 20, which comprises a drive transistor 22 and a storage capacitor 24. The column voltage is provided to the gate of the drive transistor 22, and the gate is held at this voltage by the storage capacitor 24 even after the row address pulse has ended. The drive transistor 22 draws a current from the power supply line 26.

The drive transistor 22 in this circuit is implemented as a PMOS TFT, so that the storage capacitor 24 holds the gate-source voltage fixed. This results in a fixed source-drain current through the transistor, which therefore provides the desired current source operation of the pixel. The above basic pixel circuit is a voltage-programmed pixel, and there are also current-programmed pixels which sample a drive current. However, all pixel configurations require current to be supplied to each pixel.

To date, the majority of active matrix circuits for LED displays have used low temperature polysilicon (LTPS) TFTs. The threshold voltage of these devices is stable in time, but varies from pixel to pixel in a random manner. This leads to unacceptable static noise in the image. Many circuits have been proposed to overcome this problem. In one example, each time the pixel is addressed the pixel circuit measures the threshold voltage of the current-providing TFT to overcome the pixel-to-pixel variations. Circuits of this type are aimed at LTPS TFTs and use PMOS devices. Such circuits cannot be fabricated with hydrogenated amorphous silicon (a-Si:H) devices, which is currently restricted to NMOS devices.

The use of a-Si:H has however been considered. Generally, proposed circuits using a-Si:H TFTs use current addressing rather than voltage addressing. Indeed, it has also been recognised that a current-programmed pixel can reduce or eliminate the effect of transistor variations across the substrate. For example, a current-programmed pixel can use a current mirror to sample the gate-source voltage on a sampling transistor through which the desired pixel drive current is driven. The sampled gate-source voltage is used to address the drive transistor. This partly mitigates the problem of uniformity of devices, as the sampling transistor and drive transistor are adjacent each other over the substrate and can be more accurately matched to each other. Another current sampling circuit uses the same transistor for the sampling and driving, so that no transistor matching is required, although additional transistors and address lines are required.

The currents required to drive conventional LED devices are quite large, and this has meant that the use of amorphous silicon for active matrix organic LED displays has not been possible. Recently OLEDs and solution-processed OLEDs have shown extremely high efficiencies through the use of phosphorescence. Reference is made to the articles 'Electrophosphorescent Organic Light Emitting Devices', 52.1 SID 02 Digest, May 2002, p1357 by S. R. Forrest et al, and 'Highly Efficient Solution Processible Dendrimer LEDs', L-8 SID 02 Digest, May 2002, p 1032, by J. P. J. Markham. The required currents for these devices are then within the reach of a-Si TFTs. However, additional problems come into play.

A significant problem is the stability (rather than the absolute value) of the threshold voltage of the TFTs. Under constant bias, the threshold voltage of an amorphous silicon TFT increases, therefore simple constant current circuits will cease to operate after a short time. The drift in the threshold voltage can easily be as large as 5V over typical operating lifetimes of a display of 10,000 hours or more.

Difficulties therefore remain in implementing an addressing scheme suitable for use with pixels having amorphous silicon TFTs, even for phosphorescent LED displays.

According to the invention, there is provided an active matrix electroluminescent display device comprising an array of display pixels, each pixel comprising:

an electroluminescent (EL) display element;

a first amorphous silicon drive transistor for intermittently driving a current through the display element; and a second amorphous silicon drive transistor for intermittently driving a current through the display element.

The invention is based on the recognition that the aging effect can be reduced by sharing the driving of the display element between two drive transistors. Providing a duty cycle reduces the on-time for each drive transistor, but also provides a period during which there can be some recovery of the TFT characteristics.

It has also been found that the recovery process can be improved by illuminating the first and second drive transistors with the display element output. When the display has an active plate with a black mask layer for shielding the pixel circuitry from the light of the display elements, the first and second drive transistors can be arranged not to be shielded by the black mask layer.

In a simple pixel circuit, each pixel comprises a first storage capacitor for storing a gate voltage for the first drive transistor and a second storage capacitor for storing a gate voltage for the second drive transistor, a first address transistor for applying a data signal from a first data line to the first storage capacitor and a second address transistor for applying a data signal from a second data line to the second storage capacitor. Thus, the pixel circuit uses two data lines and one row line. It is instead possible to implement a similar operation with one data line and two row lines.

The display of the invention reduces the aging effect of the amorphous silicon drive transistors. It may nevertheless be desirable to provide compensation for variations in the threshold voltages of the drive transistors over time. For this purpose, each pixel may comprise a first capacitor arrangement comprising first and second capacitors connected in series between the gate and source or drain of the first drive transistor and a second capacitor arrangement comprising first and second capacitors connected in series between the gate and source or drain of the second drive transistor, wherein a first data input to the pixel is provided to the junction between the first and second capacitors of the first capacitor arrangement and a second data input to the pixel is provided to the junction between the first and second capacitors of the second capacitor arrangement.

This pixel arrangement enables a threshold voltage for each of the drive transistors to be stored on a respective first capacitor, and this can be done each time the pixel is addressed using that drive transistor, thereby compensating for age-related changes in the threshold voltage. Thus, an amorphous silicon circuit is provided that can measure the threshold voltage of the current-providing TFT for a particular frame time to compensate for the aging effect.

In particular, the pixel layout of the invention can overcome the threshold voltage increase of amorphous silicon TFT, whilst enabling voltage programming of the pixel in a time that is sufficiently short for large high resolution AMOLED displays.

Each pixel may further comprise a first input transistor connected between a first input data line and the junction between the first and second capacitors of the first capacitor arrangement and a second input transistor connected between a second input data line and the junction between the first and second capacitors of the second capacitor arrangement. The input transistors time the application of a data voltage to the pixel, for storage on the second capacitor.

Each pixel may further comprise a first threshold sampling transistor connected between the gate and drain of the first drive transistor and a second threshold sampling transistor connected between the gate and drain of the second drive transistor. The threshold sampling transistors are used to control the supply of current from the drain (which may be connected to a power supply line) to the first capacitor. Thus, by turning on the threshold sampling transistor, the associated first capacitor can be charged to the gate-source voltage.

Each pixel may further comprise a first shorting transistor connected between the junction between the first and second capacitors of the first capacitor arrangement and the display element and a second shorting transistor connected between the junction between the first and second capacitors of the second capacitor arrangement and the display element. These are used to short out the second capacitor so that the first capacitor alone can store the gate-source voltage of the drive transistor.

Each pixel may further comprises a first bypass transistor connected between the first drive transistor source and a ground potential line and a second bypass transistor connected between the second drive transistor source and the ground potential line. These are used to act as a drain for current from the drive transistor, without illuminating the display element, particularly during the pixel programming sequence In one preferred arrangement, the first and second capacitors of the first and second capacitor arrangements are connected in series between the gate and drain of the respective drive transistor, and the drain of each drive transistor is connected to a different respective power supply line. This enables each drive transistor to source current from a high voltage line or to drain current to a low voltage line. Each drive transistor can then be operated selectively to supply current to the display element or to provide a bypass path for current from the other drive transistor. In this way, the drive transistors perform two functions, which reduces the duplication of circuit components associated with the two drive transistors.

In this compensation arrangement, the two drive transistors each have an associated capacitor arrangement for storing the threshold voltage and data voltage. In another embodiment, the capacitor arrangement can be shared. In this case, each pixel may further comprise a capacitor arrangement comprising first and second capacitors connected in series between the gate of the first and second drive transistors and a ground line, wherein the source of each drive transistor is connected to a respective control line, and wherein a data input to the pixel is provided to the junction between the first and second capacitors of the capacitor arrangement.

The drive transistors then have independent sources, and they can be selectively turned on or off using the source control lines. Each pixel preferably further comprises a shorting transistor connected across the terminals of the second capacitor and a charging transistor connected between a power supply line and the drain of the first and second drive transistors. Each pixel may further comprise a discharging transistor connected between the gates and drains of the first and second drive transistors.

In all embodiments, each drive transistor preferably comprises an NMOS transistor, and the electroluminescent (EL) display element may comprise an electrophosphorescent organic electroluminescent display element.

The invention also provides a method of driving an active matrix electroluminescent display device comprising an array of display pixels, each pixel comprising an electroluminescent (EL) display element, the method comprising:

alternately, driving current through the display element using first and second amorphous silicon drive transistors, a drive transistor being turned off when it is not driving current through the display element.

This method reduces the aging effect by sharing the driving of the display element between two drive transistors.

The drive transistors are preferably illuminated by the display element and this is found to reverse the effect of aging on the TFT characteristics.

In addition to reducing the aging effects, compensation can be carried out for variations over time of the threshold voltages of the first and second drive transistors.

This compensation can comprise:

driving a current through one of the drive transistors to ground, and charging a first capacitor to the resulting gate-source voltage;

discharging the first capacitor until the one drive transistor turns off, the first capacitor thereby storing a threshold voltage;

charging a second capacitor, in series with the first capacitor between the gate and source or drain of the drive transistor, to a data input voltage; and using the drive transistor to drive a current through the display element using a gate-source voltage or gate-drain voltage which comprises the combination of voltages across the first and second capacitors.

The step of driving a current through one of the drive transistors to ground can comprise driving the current through the other of the drive transistors to ground. In this way, the drive transistors can perform a double function.

The invention will now be described by way of example with reference to the accompanying drawings, in which.

The same reference numerals are used in different figures for the same components, and description of these components will not be repeated.

The invention provides recovery of amorphous silicon TFT characteristics by providing each pixel with more than one current-providing TFT so that one TFT can provide current to the LED and the remaining drive TFTs are in the off state. They may also be illuminated to enhance the recovery process.

Figure 3:
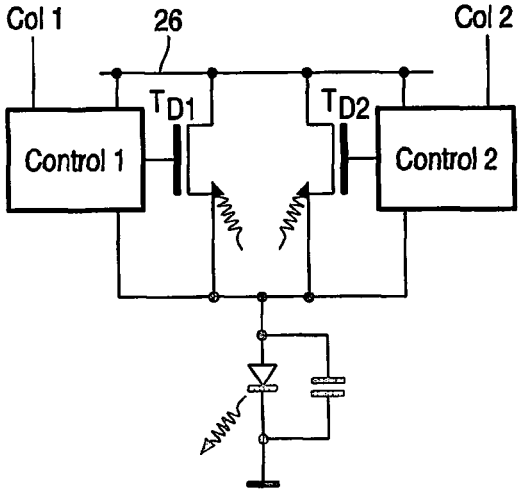
FIGS. 3 and 4 illustrate schematically the basic principle underlying the invention.
Figure 4:
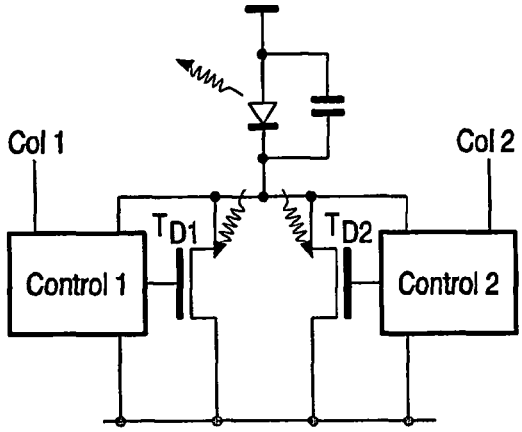

FIGS. 3 and 4 illustrate schematically the basic principle underlying the invention.

FIG. 3 shows two drive TFTs $T_{D1}$ and $T_{D2}$ for driving the anode of the LED display element. Each drive transistor is controlled by a respective control circuit "Control1" and "Control2" which receives the data input along a respective column line "Col1" and "Col2". FIG. 4 shows two drive TFTs $T_{D1}$ and $T_{D2}$ for driving the cathode of the LED display element. This is more difficult to implement, but more suited to N-type circuits. FIGS. 3 and 4 show schematically circuits with two drive transistors, but more than two could be used.

Figure 1:
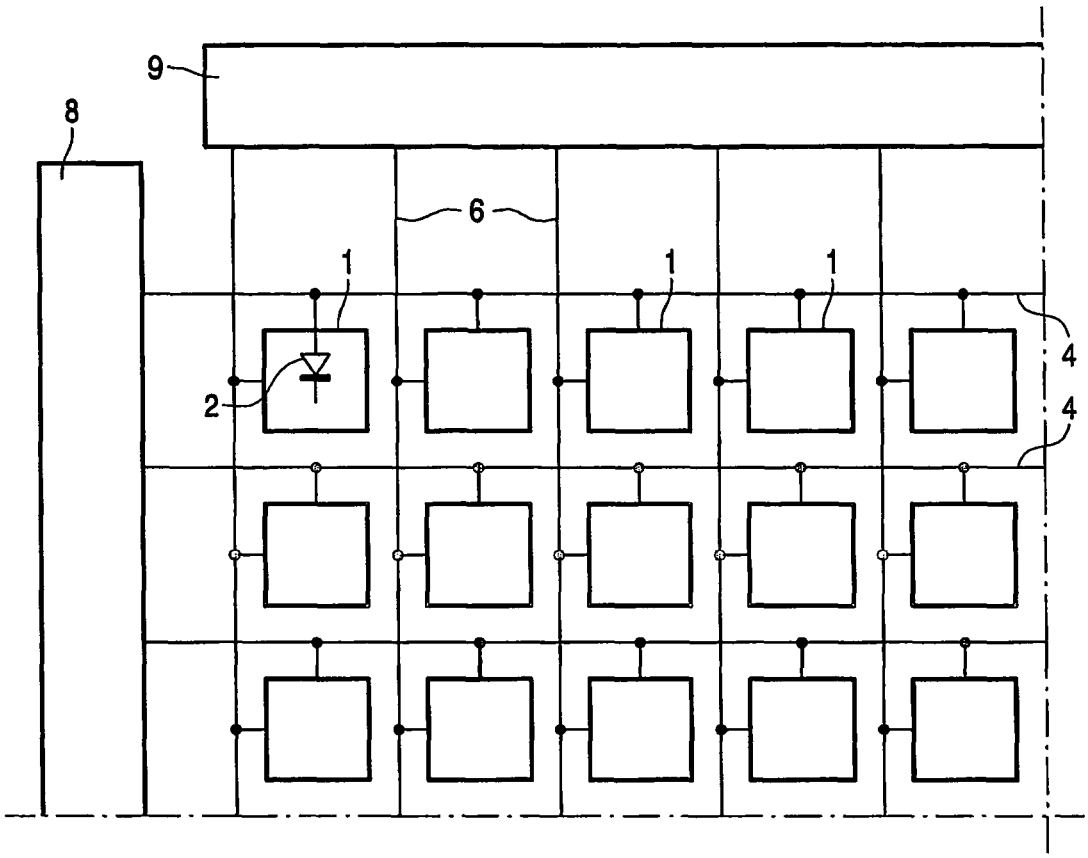
FIG.1 PRIOR ART
FIG. 1 shows a known EL display device.
Figure 2:
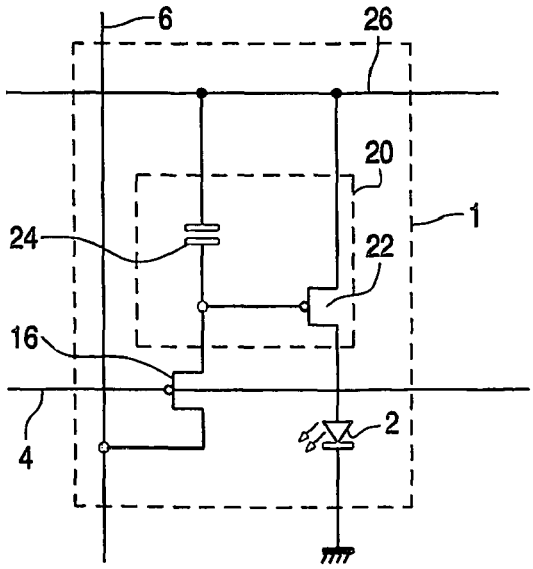
FIG.2 PRIOR ART
FIG. 2 is a schematic diagram of a known pixel circuit for current-addressing the EL display pixel using an input drive voltage.

In FIG. 3, each control circuit may simply comprise the circuit components of the standard pixel layout of FIG. 2, with a shared power line 26 and with each control circuit driving a shared display element 2. Likewise, the control circuits in FIG. 4 may be based on the same pixel circuit.

In FIGS. 3 and 4, when TFT $T_{D1}$ is driving current into the LED, TFT $T_{D2}$ is turned off. The state of the TFTs is controlled by the relevant circuitry connected to the gate, drain and common source of the TFTs.

In a preferred arrangement, as $T_{D1}$ lights the LED, some of that light can be allowed to fall upon the drive TFTs $T_{D1}$ and $T_{D2}$. In $T_{D2}$ this will allow recovery of the threshold voltage drift. After a period of time the control will allow $T_{D2}$ to become the current-providing TFT and $T_{D1}$ to be turned off and recover. This process will continue throughout the lifetime of the display. The result is that the two drive TFTs are used approximately half of the time. When a TFT is not being used for driving the display element, the TFT can recover.

Instead or as well as providing illumination of the TFTs, a negative gate bias can be applied to the drive TFT which is not being used. By providing a larger negative bias than is required to turn the TFT off, the rate of recovery of TFT characteristics can also be enhanced.

To implement the above scheme it must be possible to independently control at least the gate or source of each drive TFT so that a voltage above the threshold gate-source voltage is provided on one drive TFT and a voltage below the threshold gate-source voltage is provided for the other drive TFT.

As shown in FIGS. 3 and 4, one possible implementation provides an additional column (data) line for each pixel, so that each pixel has two data lines. The data from each column line drives a respective one of the drive TFT gates. The required alternation of the use of the two drive transistors is achieved by alternating the drive signals on the two column lines.

Figure 5:
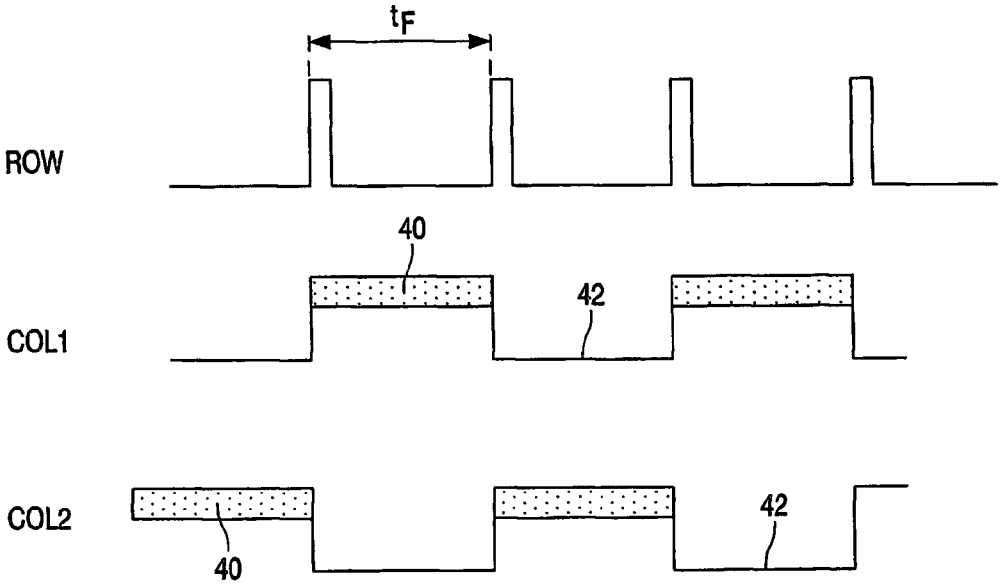
FIG. 5 shows suitable drive signals for operating the pixel layouts of FIGS. 3 and 4.

FIG. 5 shows suitable drive signals for the row line and for the two column lines. In this example, the use of the two drive transistors is alternated on alternate display fields, the field period being shown as $t_F$. In one field, $T_{D1}$ is driven by a data signal on Col1 and $T_{D2}$ is driven with an off drive level. In the next field, $T_{D2}$ is driven by a data signal on Col2 and $T_{D1}$ is driven with an off drive level. Alternation may instead be after a block of field periods.

Regions 40 indicate the range of data levels for controlling the drive TFTs and voltage level 42 is for turning the transistor off.

FIGS. 3 and 4 schematically show illumination of the drive transistors by the display element. This can be achieved by the use of an ITO gate for a top-gate TFT structure, and by removing part of the black mask layer from a conventional bottom gate TFT structure. All other TFTs in the pixel remain shielded from incident light, by having opaque metal gates or black mask layer portions associated with their gates.

Figure 6:
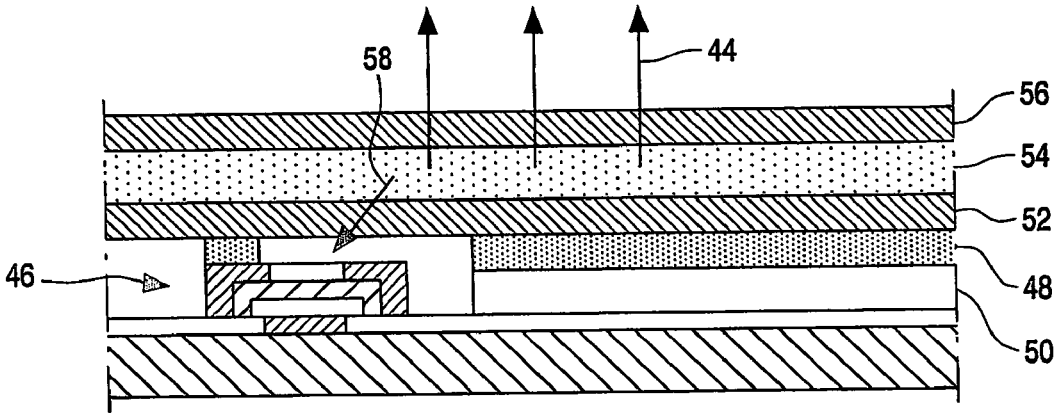
FIG. 6 shows a top emission structure a bottom-gate TFT showing illumination of the drive TFTs.

FIG. 6 shows a top emission structure (arrows 44) with a bottom-gate TFT 46. A black mask layer 48 has an opening over at least the gate of each drive TFT (only one of which is shown). The black mask layer overlies the control circuitry 50 of the pixels, and ITO anode 52, LED layer 54 and cathode 56 are provided over the black mask layer 48. Arrow 58 represents illumination of the drive TFT.

Figure 7:
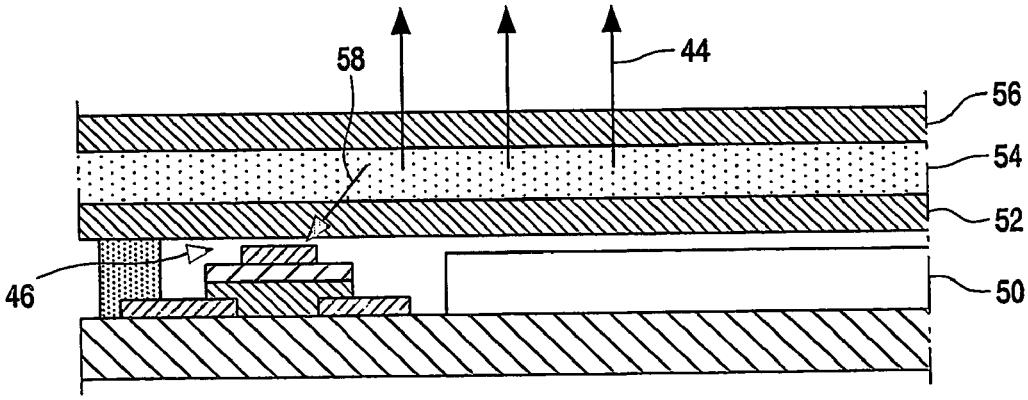
FIG. 7 shows a top emission structure with a top-gate TFT showing illumination of the drive TFTs.

FIG. 7 also shows a top emission structure with a top-gate TFT 46. The gate of each drive TFT (only one of which is shown) is transparent, for example formed from ITO, and the other transistors in the control circuitry 50 have opaque gate conductors. It may be sufficient for light to fall on the amorphous silicon area outside the gate region, so that an ITO gate is not needed. An ITO gate is thus one possible implementation of a TFT which is to be illuminated.

Bottom emission configurations are also possible, in which an aperture is formed in the circuitry through which light enters and passes through the substrate.

The extra leakage currents resulting from the active drive TFT being illuminated should not affect the displayed level provided such currents are kept below half the LSB current, for example less than 1 nA.

Figure 8:
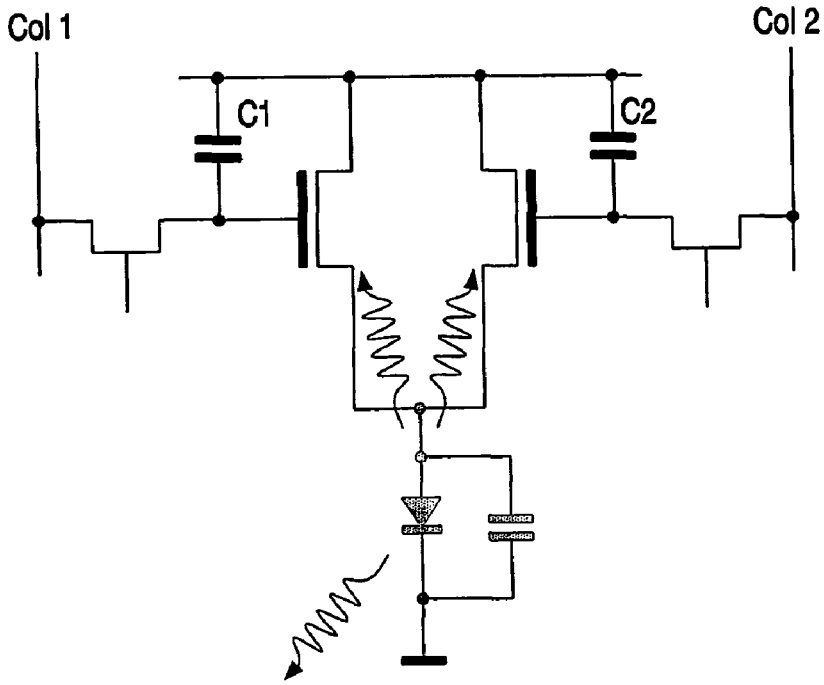
FIG. 8 shows in more detail a first way of implementing the arrangement of FIG. 3.

As mentioned above, each control circuit can correspond to the standard pixel circuit of FIG. 2, or indeed a modified version of FIG. 2 using NMOS transistors. FIG. 8 shows the arrangement of FIG. 3 using an NMOS pixel circuit, although corresponding essentially to the circuit of FIG. 2.

Figure 9:
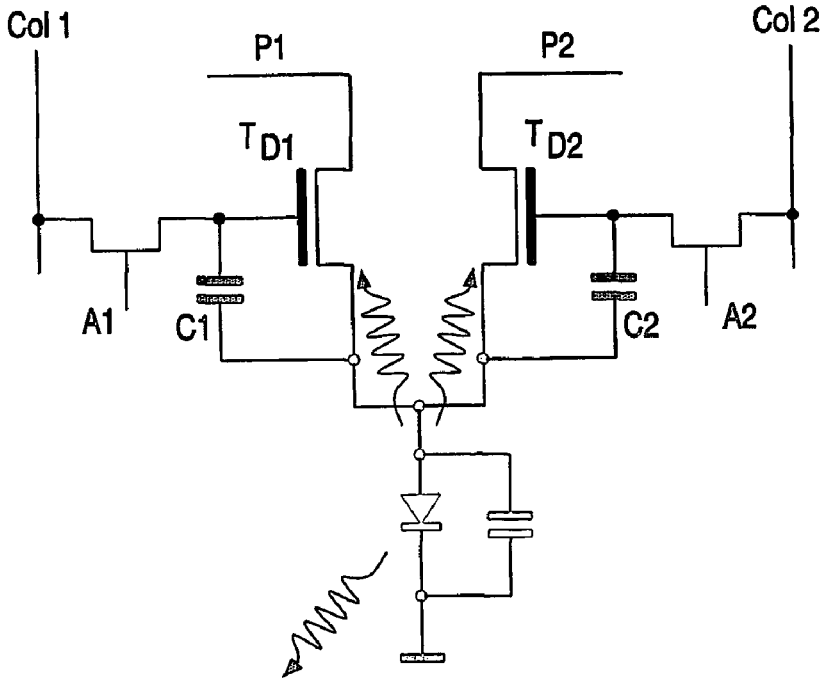
FIG. 9 shows in more detail a second way of implementing the arrangement of FIG. 3.

FIG. 9 shows that the storage capacitors can instead be connected between the gate of the associated drive transistor and the display anode. Each drive transistor is then supplied by a respective power line P1, P2.

The addressing sequence for this arrangement is slightly different. In order to store a voltage on the storage capacitor C1, power line P2 is held at ground and P1 is high. Capacitor C2 will be charged to a high voltage to turn on drive transistor $T_{D2}$, which thereby holds the display anode to a low voltage (that of the power line P2). The source voltage on $T_{D1}$ is therefore constant while a data voltage is stored on C1.

After the voltage has been stored on C1, the address line A1 is brought low to disconnect the data line Col1 from the capacitor C1. C2 is then discharged to zero volts by means of the second address line A2, to turn off $T_{D2}$. The second address line is then brought low, and the gates of the two TFTs float to the correct operating level. The operation is swapped between the two sides of the circuit.

Figure 10:
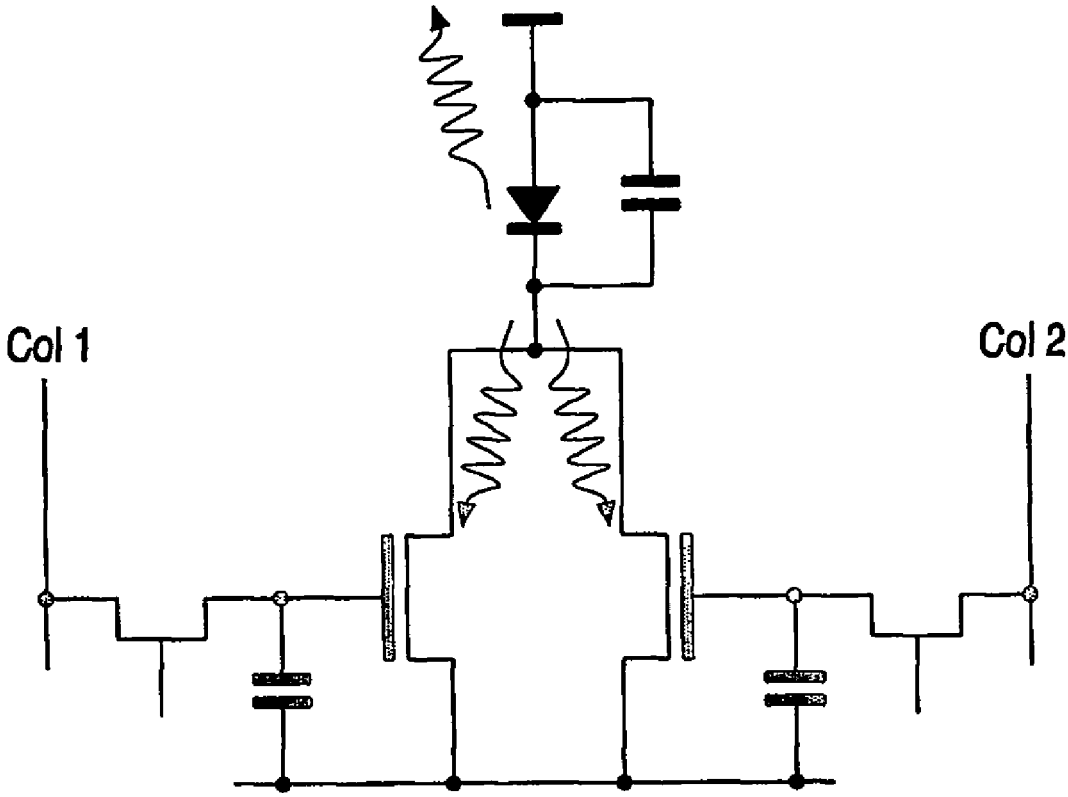
FIG. 10 shows in more detail a first way of implementing the arrangement of FIG. 4.

FIG. 10 shows a further possible arrangement for pixels where the cathode connects to the pixel circuitry (as in FIG. 4). The capacitors may instead be connected between the TFT gates and the common display element cathode.

The illumination technique for threshold voltage drift recovery will not be perfect and it is very likely that drift in the threshold voltage will still occur, although at a significantly lower level. Therefore achieving accurate grey scale will require a technique for threshold voltage measurement to be included in the circuit.

Figure 11:
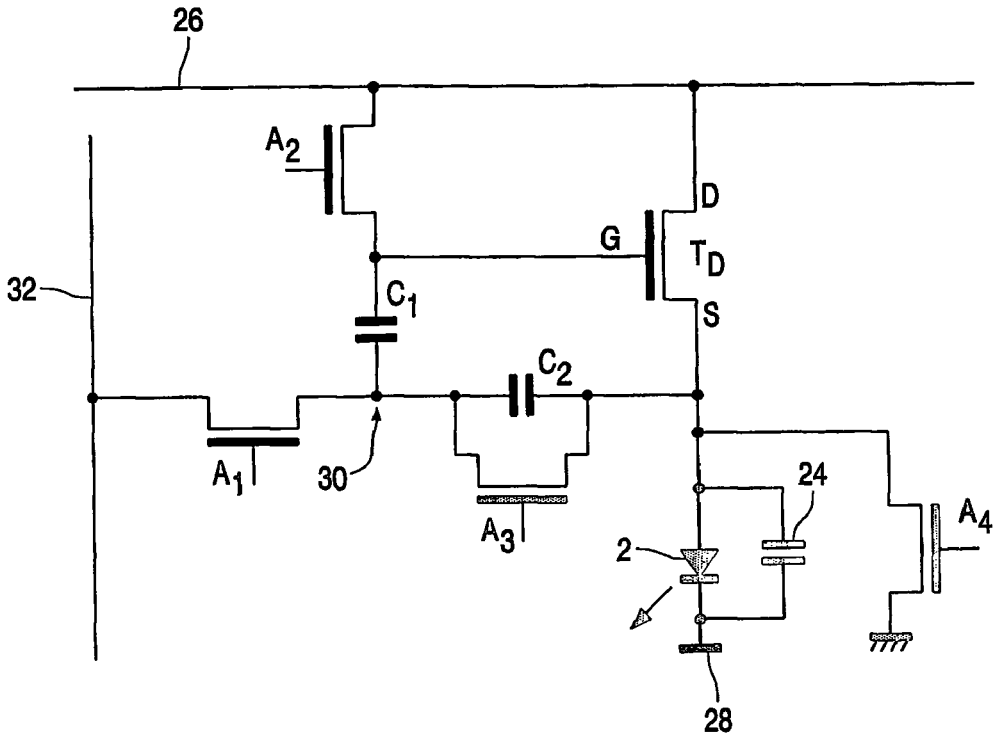
FIG. 11 shows a schematic diagram of a first example of pixel layout with threshold voltage compensation of the invention.

FIG. 11 shows a compensation circuit which has been proposed by the applicant. The operation of this circuit will first be described, and improvements to the circuit will then be discussed which simplify the duplication of the circuit (one for each drive transistor) into a single pixel having two (or more) drive transistors in accordance with the invention.

Each pixel has an electroluminescent (EL) display element 2 and an amorphous silicon drive transistor $T_D$ in series between a power supply line 26 and a cathode line 28. The drive transistor $T_D$ is for driving a current through the display element 2.

First and second capacitors $C_1$ and $C_2$ are connected in series between the gate and source of the drive transistor $T_D$. A data input to the pixel is provided to the junction 30 between the first and second capacitors and charges the second capacitor $C_2$ to a pixel data voltage as will be explained below. The first capacitor $C_1$ is for storing a drive transistor threshold voltage on the first capacitor $C_1$.

An input transistor $A_1$ is connected between an input data line 32 and the junction 30 between the first and second capacitors. This first transistor times the application of a data voltage to the pixel, for storage on the second capacitor $C_2$.

A second transistor $A_2$ is connected between the gate and drain of the drive transistor $T_D$. This is used to control the supply of current from the power supply line 26 to the first capacitor $C_1$. Thus, by turning on the second transistor $A_2$, the first capacitor $C_1$ can be charged to the gate-source voltage of the drive transistor $T_D$.

A third transistor $A_3$ is connected across the terminals of the second capacitor $C_2$. This is used to short out the second capacitor so that the first capacitor alone can store the threshold voltage of the drive transistor $T_D$.

A fourth transistor $A_4$ is connected between the source of the drive transistor $T_D$ and ground. This is used to act as a drain for current from the drive transistor, without illuminating the display element, particularly during the pixel programming sequence.

The capacitor 24 may comprise an additional storage capacitor (as in the circuit of FIG. 2) or it may comprise the self-capacitance of the display element.

The transistors $A_1$ to $A_4$ are controlled by respective row conductors which connect to their gates. As will be explained further below, some of the row conductors may be shared. The addressing of an array of pixels thus involves addressing rows of pixels in turn, and the data line 32 comprises a column conductor, so that a full row of pixels is addressed simultaneously, with rows being addressed in turn, in conventional manner.

The circuit of FIG. 11 can be operated in a number of different ways. The basic operation will first be described, and the way this can be extended to provide pipelined addressing is then explained. Pipelined addressing means there is some timing overlap between the control signals of adjacent rows.

Figure 12:
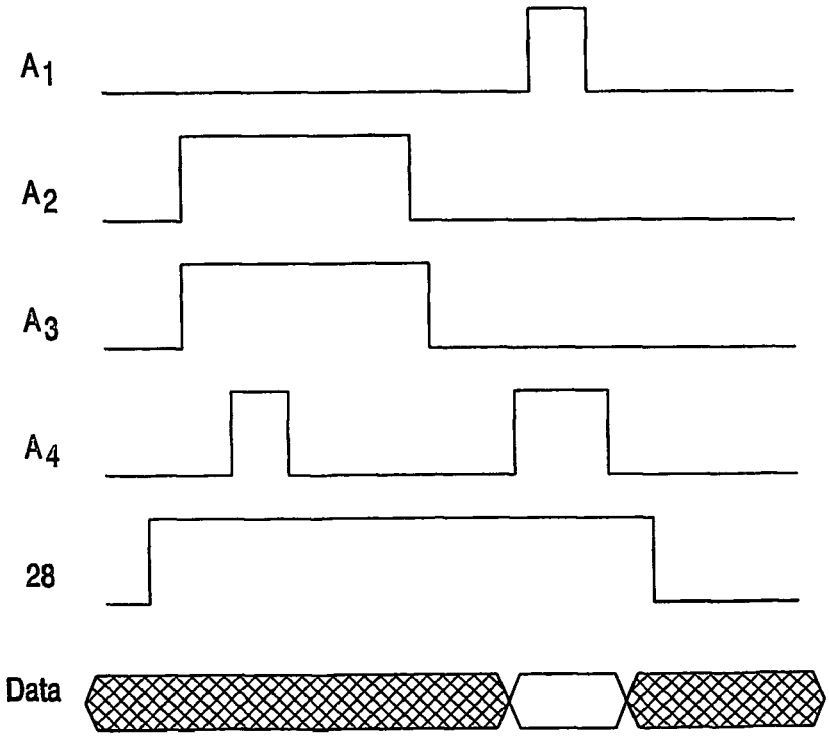
FIG. 12 is a timing diagram for a first method of operation of the pixel layout of FIG. 11.

Only the drive transistor $T_D$ is used in constant current mode. All other TFTs $A_1$ to $A_4$ in the circuit are used as switches that operate on a short duty cycle. Therefore, the threshold voltage drift in these devices is small and does not affect the circuit performance. The timing diagram is shown in FIG. 12. The plots $A_1$ to $A_4$ represent the gate voltages applied to the respective transistors. Plot "28" represents the voltage applied to cathode line 28, and the clear part of the plot "DATA" represents the timing of the data signal on the data line 32. The hatched area represents the time when data is not present on the data line 32. It will become apparent from the description below that data for other rows of pixels can be applied during this time so that data is almost continuously applied to the data line 32, giving a pipelined operation.

The circuit operation is to store the threshold voltage of the drive transistor $T_D$ on $C_1$, and then store the data voltage on $C_2$ so that the gate-source of $T_D$ is the data voltage plus the threshold voltage.

The circuit operation comprises the following steps.

The cathode (line 28) for the pixels in one row of the display is brought to a voltage sufficient to keep the LED reversed bias throughout the addressing sequence. This is the positive pulse in the plot "28" in FIG. 12.

Address lines $A_2$ and $A_3$ go high to turn on the relevant TFTs. This shorts out capacitor $C_2$ and connects one side of capacitor $C_1$ to the power line and the other to the LED anode.

Address line $A_4$ then goes high to turn on its TFT. This brings the anode of the LED to ground and creates a large gate-source voltage on the drive TFT $T_D$. In this way $C_1$ is charged, but not $C_2$ as this remains short circuited.

Address line $A_4$ then goes low to turn off the respective TFT and the drive TFT $T_D$ discharges capacitor $C_1$ until it reaches its threshold voltage. In this way, the threshold voltage of the drive transistor $T_D$ is stored on $C_1$. Again, there is no voltage on the second capacitor $C_2$.

$A_2$ is brought low to isolate the measured threshold voltage on the first capacitor $C_1$, and $A_3$ is brought low so that the second capacitor $C_2$ is no longer short-circuited.

$A_4$ is then brought high again to connect the anode to ground. The data voltage is then applied to the second capacitor $C_2$ whilst the input transistor is turned on by the high pulse on $A_1$.

Finally, $A_4$ goes low followed by the cathode been brought down to ground. The LED anode then floats up to its operating point.

The cathode can alternatively be brought down to ground after $A_2$ and $A_3$ have been brought low and before $A_4$ is taken high.

The addressing sequence can be pipelined so that more than one row of pixels can be programmed at any one time. Thus, the addressing signals on lines $A_2$ to $A_4$ and the row wise cathode line 28 can overlap with the same signals for different rows. Thus, the length of the addressing sequence does not imply long pixel programming times, and the effective line time is only limited by the time required to charge the second capacitor $C_2$ when the address line $A_1$ is high. This time period is the same as for a standard active matrix addressing sequence. The other parts of the addressing mean that the overall frame time will only be lengthened slightly by the set-up required for the first few rows of the display. However this set can easily be done within the frame-blanking period so the time required for the threshold voltage measurement is not a problem.

Figure 13:
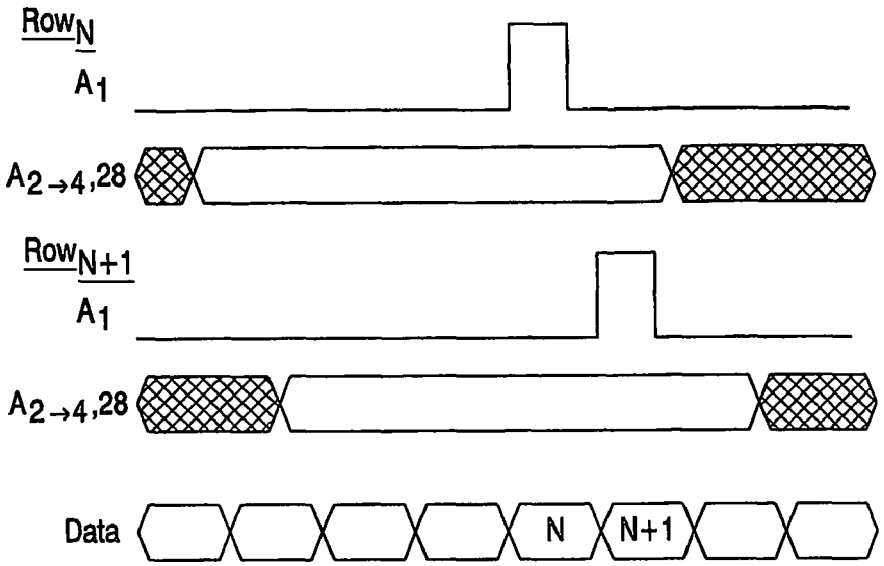
FIG. 13 is a timing diagram for a second method of operation of the pixel layout of FIG. 11.

Pipelined addressing is shown in the timing diagrams of FIG. 13. The control signals for the transistors $A_2$ to $A_4$ have been combined into a single plot, but the operation is as described with reference to FIG. 11. The "Data" plot in FIG. 13 shows that the data line 32 is used almost continuously to provide data to successive rows.

In the method of FIGS. 12 and 13, the threshold measurement operation is combined with the display operation, so that the threshold measurement and display is performed for each row of pixels in turn.

Figure 14:
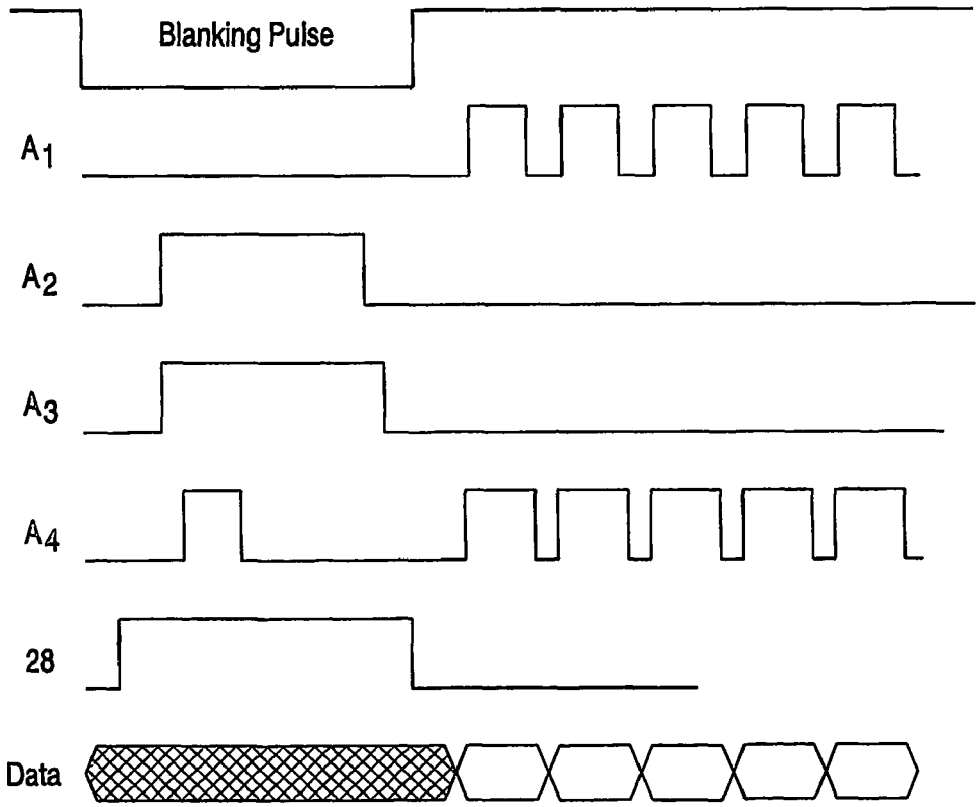
FIG. 14 is a timing diagram for a third method of operation of the pixel layout of FIG. 11.

FIG. 14 shows timing diagrams for a method in which the threshold voltages are measured at the beginning of the frame for all pixels in the display. The plots in FIG. 14 correspond to those in FIG. 12. The advantage of this approach is that a structured cathode (namely different cathode lines 28 for different rows, as required to implement the method of FIGS. 12 and 13) is not required, but the disadvantage is that leakage currents may result in some image non-uniformity. The circuit diagram for this method is still that of FIG. 11.

As shown in FIG. 14, the signals $A_2$, $A_3$, $A_4$ and the signal for cathode line 28 in FIG. 14 are supplied to all pixels in the display in a blanking period to perform the threshold voltage measurement. Signal $A_4$ is supplied to every pixel simultaneously in the blanking period, so that all the signals $A_2$ to $A_4$ are supplied to all rows at the same time. During this time, no data can be provided to the pixels, hence the shaded portion of the data plot at the base of FIG. 14.

In the subsequent addressing period, data is supplied separately to each row in turn, as is signal $A_1$. The sequence of pulses on $A_1$ in FIG. 14 represent pulses for consecutive rows, and each pulse is timed with the application of data to the data lines 32.

Figure 15:
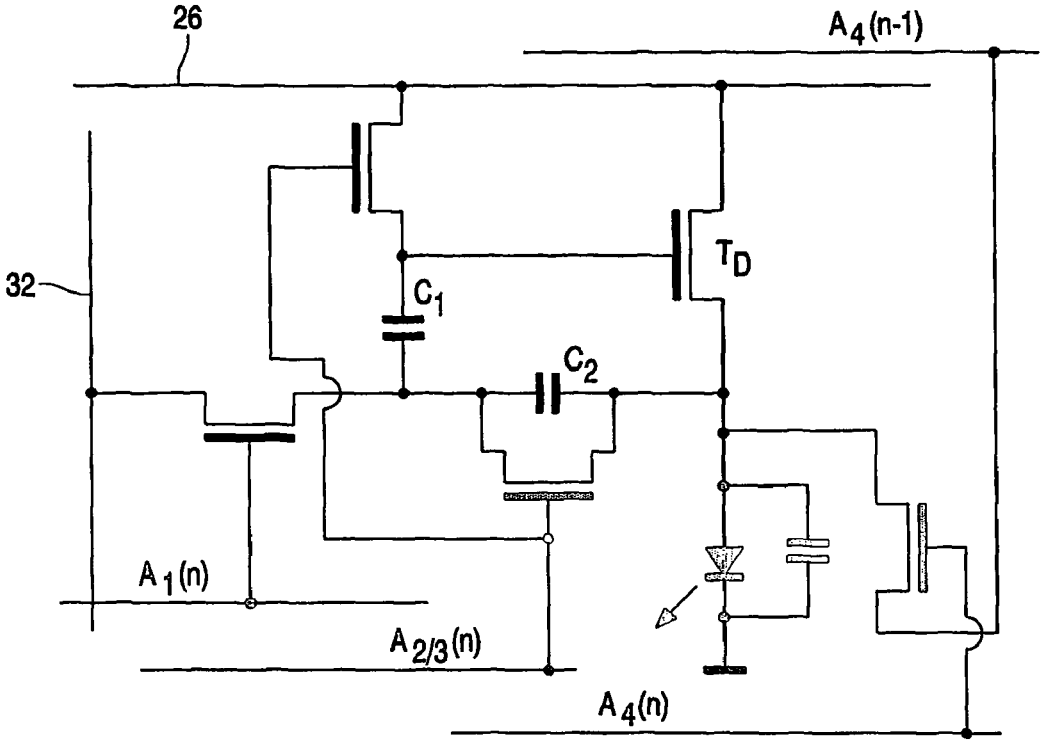
FIG. 15 shows a modification to the circuit of FIG. 11.

The circuit in FIG. 11 has large number of rows, for the control of the transistors and for the structure cathode lines (if required). FIG. 15 shows a circuit modification which reduces the number of rows required. The timing diagrams show that signals $A_2$ and $A_3$ are very similar. Simulations show that $A_2$ and $A_3$ can in fact be made the same so that only one address line is required. A further reduction can be made by connecting the ground line associated with the transistor $A_4$ in FIG. 11 to the address line $A_4$ in a previous row. The circuit in FIG. 15 shows the address lines for row n and row n-1.

To implement a threshold voltage recovery circuit combined with the compensation for multiple drive TFTs, the compensation circuit needs to be repeated for every drive TFT. Whilst one section of control circuitry is set up to perform a threshold voltage measurement and having data added, the other section of control circuitry has its capacitors discharged to make sure the drive TFT it is connected to is turned off.

The threshold compensation circuit described above will have a high component count and numerous address lines, and therefore could be difficult to fit within a pixel area.

Figure 16:
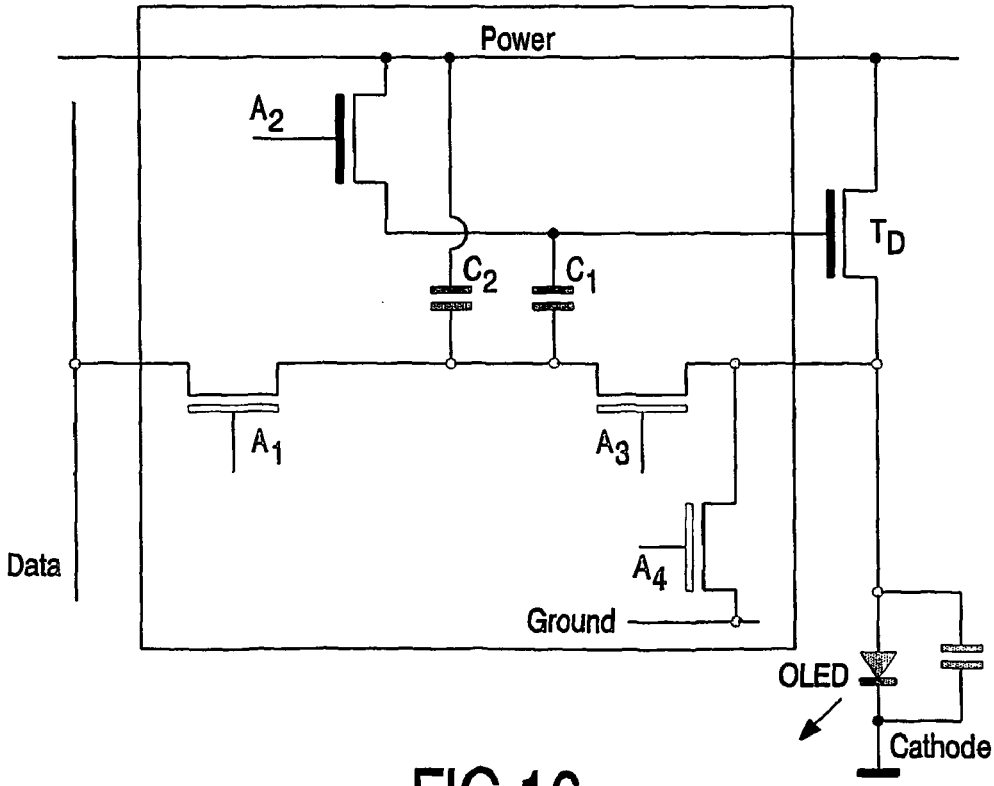
FIG. 16 shows a schematic diagram of a second example of pixel layout with threshold voltage compensation of the invention.
Figure 18:
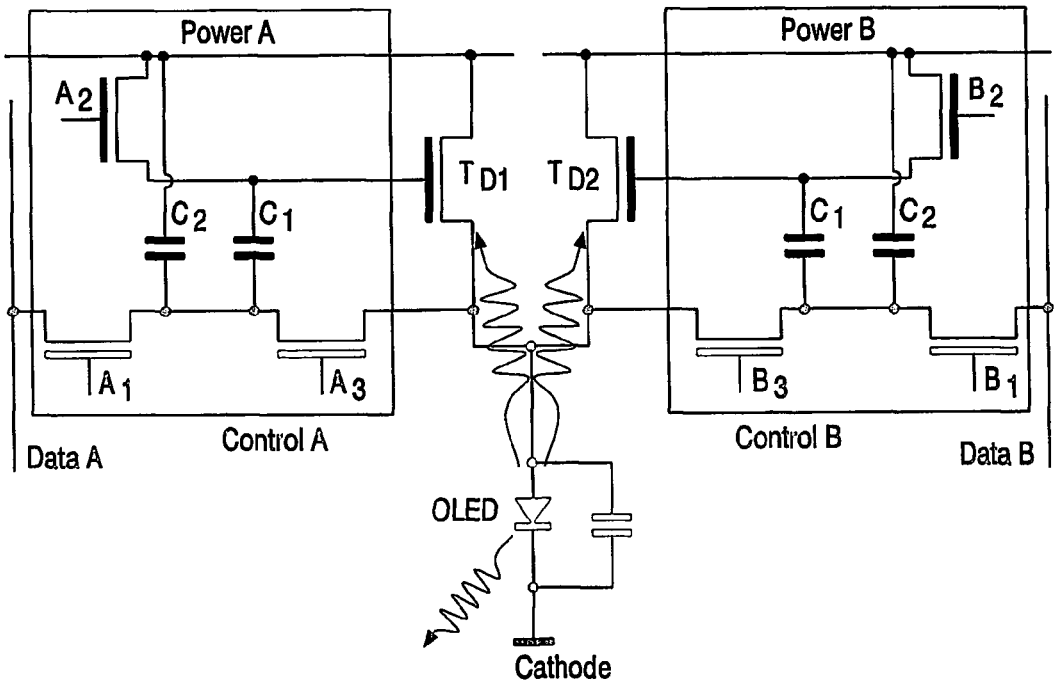
FIG. 18 shows how two of the circuits of FIG. 16 are integrated into a single pixel

FIG. 16 shows a modification to the circuit of FIG. 11 which enables the duplication of the circuit into a single pixel to be simplified, which will become apparent from the description below with reference to FIG. 18. The component count is reduced by allowing some of the TFTs to have dual functions. Independent control of either the source or gate of the drive TFTs is required, and all TFTs used for controlling the two drive TFTs must operate on a normally off basis i.e. have a low duty cycle, unless these TFTs have some $V_T$ drift correction themselves.

The TFT connected to address line $A_4$ in FIG. 11 will be large, as it needs to pass the current delivered by the drive TFT in the addressing period. Therefore this TFT is an ideal candidate for a dual purpose TFT i.e. one that acts both as a driving TFT and an addressing TFT. Unfortunately the circuit shown in FIG. 11 will not allow this.

In FIG. 16, the same reference numerals are used to denote the same components as in the circuit of FIG. 11, and description is not repeated.

In this circuit, the first and second capacitors $C_1$ and $C_2$ are connected in series between the gate and drain of the drive transistor $T_D$. Again, the input to the pixel is provided to the junction between the capacitors. The first capacitor $C_1$ for storing the threshold voltage is connected between the drive transistor gate and the input. The second capacitor $C_2$ for storing the data input voltage is connected directly between the pixel input and the power supply line (to which the transistor drain is connected). The transistor connected to control line $A_3$, is again for providing a charging path for the first capacitor $C_1$ which bypasses the second capacitor $C_2$, so that the capacitor $C_1$ alone can be used to store a threshold gate-source voltage.

Figure 17:
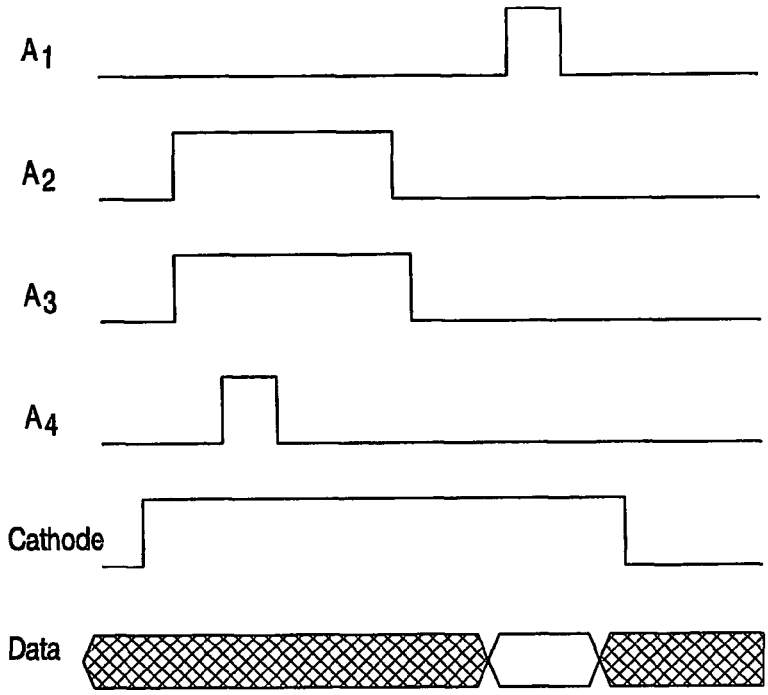
FIG. 17 is a timing diagram for operation of the pixel layout of FIG. 16.

The circuit operation is shown in FIG. 17 and has the following steps:

The cathode for the pixels in one row of the display is brought to a voltage sufficient to keep the LED reversed bias throughout the addressing sequence.

Address lines $A_2$ and $A_3$ go high to turn on the relevant TFTs, this connects the parallel combination of $C_1$ and $C_2$ to the power line.

Address line $A_4$ then goes high to turn on its TFT, this brings the anode of the LED to ground and creates a large gate-source voltage on the drive TFT $T_D$.

Address line $A_4$ then goes low to turn off the TFT and the drive TFT $T_D$ discharges the parallel capacitance $C_1$+$C_2$ until it reaches its threshold voltage.

Then $A_2$ and $A_3$ are brought low to isolate the measured threshold voltage.

$A_1$ is then turned on and the data voltage is stored on capacitance $C_1$.

Finally $A_4$ goes low followed by the cathode being brought down to ground.

Again, pipelined addressing or threshold measurement in the blanking period can be performed with this circuit, as explained above.

A voltage $V_{data}$–$V_T$ is thus stored on the gate-drain of the drive TFT. Therefore:

$$I = \frac{\beta}{2}(V_{gs} - V_T)^2 = \frac{\beta}{2}(V_{ds} - V_{dg} - V_T)^2 = \frac{\beta}{2}(V_{ds} - V_{data})^2$$

Figure 19:
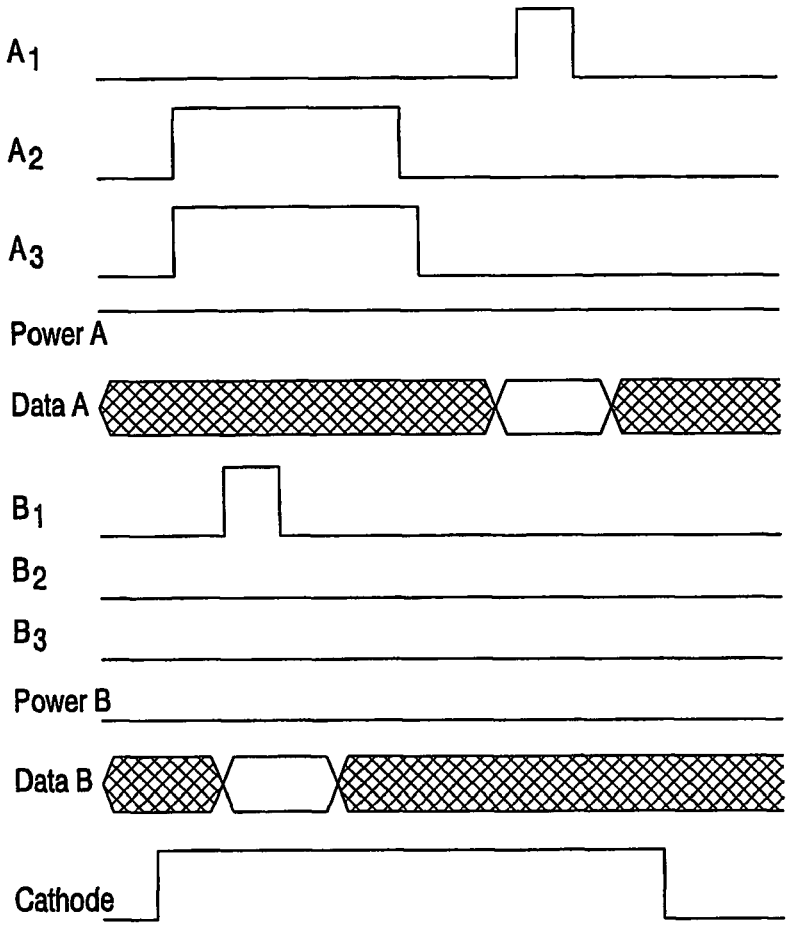
FIG. 19 is a timing diagram for operation of the pixel layout of FIG. 18.

Hence, the threshold voltage dependence is removed. It is noted that the current is now dependent upon the LED anode voltage. A threshold voltage measuring circuit with recovery via illumination based on this circuit is shown in FIG. 18 and the timing diagram in shown in FIG. 19.

Assuming that $T_{D1}$ is driving and $T_{D2}$ is recovering, then the left hand side of the circuit performs as before and the right hand side of the circuit has to perform the function of the TFT connected to $A_4$ in FIG. 16 i.e. pulling the anode to ground. To achieve this, power line B must be at ground, address lines $B_2$ and $B_3$ must be low and $B_1$ must go high along with data line B to pull the gate of $T_{D2}$ high to connect the anode to ground when required in the addressing phase of $T_{D1}$.

The circuit is symmetric about the LED so the signals simple swap between the two sides of the circuit when $T_{D1}$ is in recovery and $T_{D2}$ is driving. Pipelined signals are still possible, as is $V_T$ measurement in the blanking period.

The circuit above still has rather a large number of components (due to the independent gate and source of the driving TFTs). A circuit with only one node independent i.e. source or gate can result in a lower component count. In the following, a circuit is described that uses circuitry on the cathode side of the LED and uses independent source voltages to achieve a threshold voltage measurement circuit with recovery. A single threshold voltage measurement circuit will be initially be described with reference to FIG. 20 and the timing diagram in FIG. 21.

Figure 20:
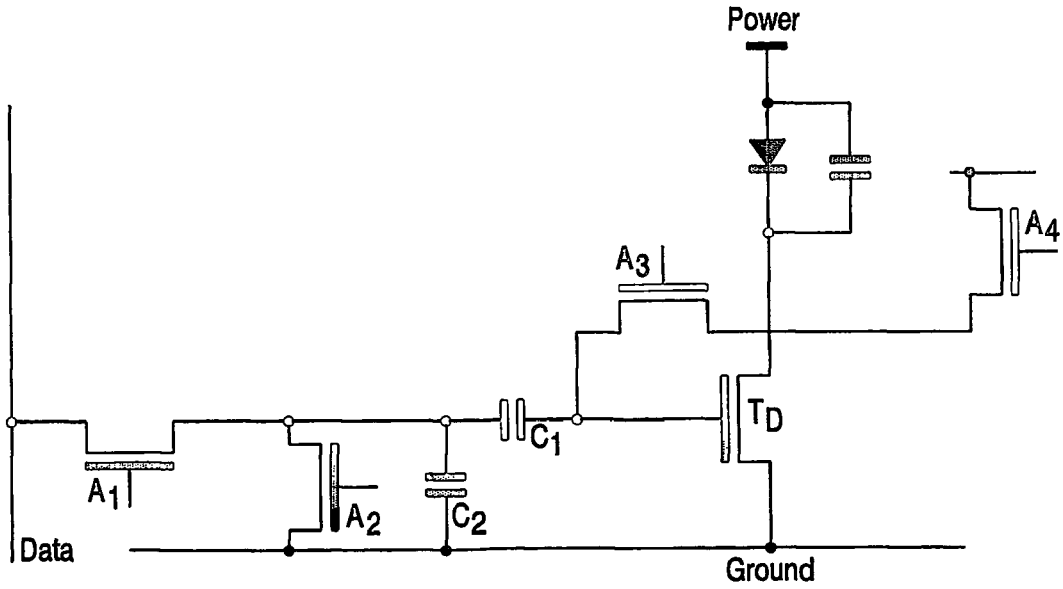
FIG. 20 shows a schematic diagram of a third example of pixel layout with threshold voltage compensation of the invention.
Figure 21:
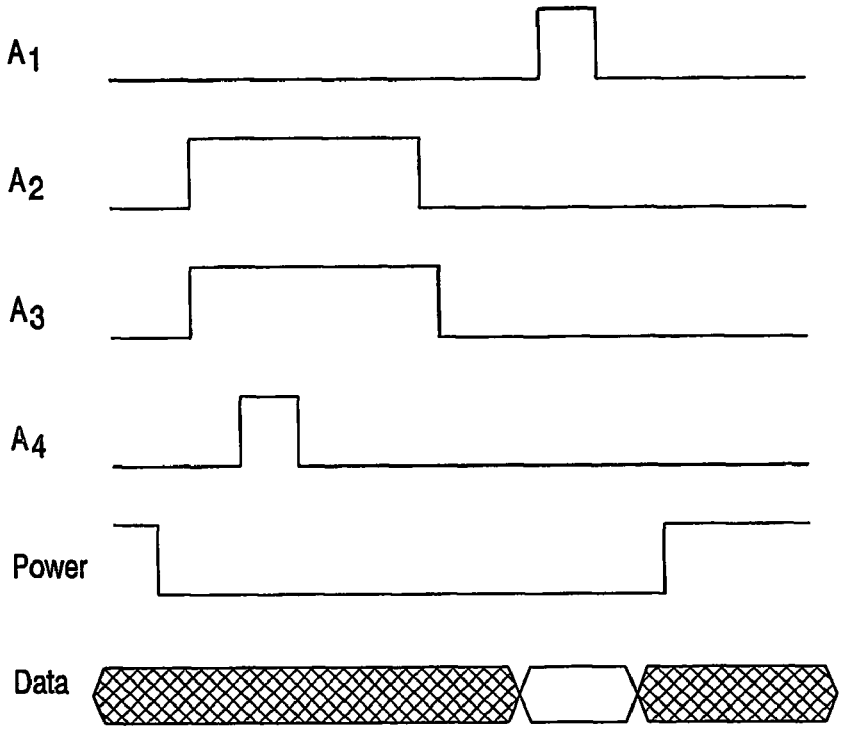
FIG. 21 is a timing diagram for operation of the pixel layout of FIG. 20.

In the circuit of FIG. 20, each pixel has first and second capacitors $C_1$, $C_2$ connected in series between the gate of the drive transistor $T_D$ and a ground line. The source of the drive transistor is connected to the ground line, but when two circuits are combined, the source of each drive transistor is then connected to a respective control line. A data input to the pixel is again provided to the junction between the first and second capacitors.

A shorting transistor is connected across the terminals of the second capacitor $C_2$ and controlled by line $A_2$. As in the previous circuits, this enables a gate-source voltage to be stored on the capacitor $C_1$ bypassing capacitor $C_2$. A charging transistor associated with control line $A_4$ is connected between a power supply line 50 and the drain of the drive transistor $T_D$. This provides a charging path for the capacitor $C_1$, together with a discharging transistor associated with control line $A_3$ and connected between the gate and drain of the drive transistor.

The circuit operates by holding $A_2$ and $A_3$ high, $A_4$ is then held high momentarily to pull the cathode high and charge the capacitor $C_1$ to a high gate-source voltage. The power line is at ground to reverse bias the LED. $T_D$ then discharges to its threshold voltage (the discharge transistor associated with line $A_3$ being turned on) and it is stored on $C_1$. $A_2$ and $A_3$ are then brought low, $A_1$ is brought high and the data is addressed onto $C_2$. The power line is then brought high again to light the LED.

Again, the addressing sequence can be pipelined or the threshold voltages can be measured in a field blanking period.

Figure 22:
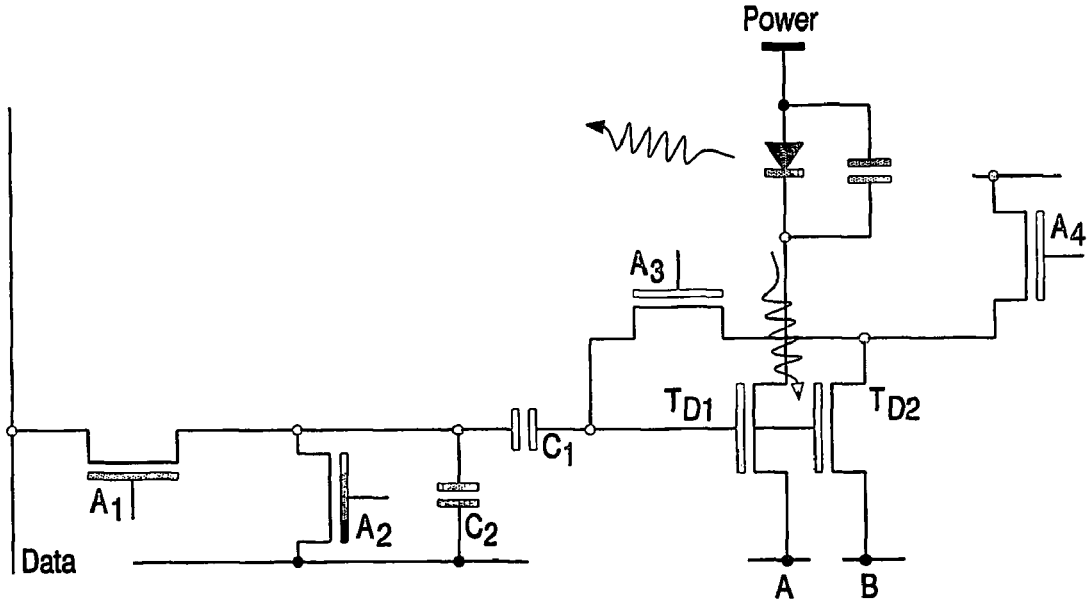
FIG. 22 shows how two of the circuits of FIG. 20 are integrated into a single pixel.

The construction of a recovery circuit with an independent source requires that both drive TFTs have their own ground lines. An extra capacitor line connected to $C_2$ is also be required. The recovery circuit is shown in FIG. 22.

In this circuit, the capacitors are shared between both drive transistors, and the other transistors of the circuit do not need to be duplicated. Each drive transistor has an associated control line A, B connected to the cathode.

The operation is very similar to the operation described above and shown in FIG. 21. However, either line A or line B needs to be at a potential which will turn off the relevant drive TFT when it is in it recovery mode. Assuming that both drive TFTs have similar threshold voltages, then the difference in the voltages on lines A and B will need to be the data voltage range, and this will obviously swap as the mode of each drive TFT changes from drive to recovery.

The circuit can be used for currently available LED devices. However, the electroluminescent (EL) display element may comprise an electrophosphorescent organic electroluminescent display element. The invention enables the use of a-Si:H for active matrix OLED displays.

The circuit above has been shown implemented with only NMOS transistors, and these will all be amorphous silicon devices. Although the fabrication of NMOS devices is preferred in amorphous silicon, alternative circuits could of course be implemented with PMOS devices.

In the preferred examples above, there are two drive transistors. It will be understood that each pixel may have three or more drive transistors, and compensation circuits may again be provided for each drive transistor, sharing circuit components where possible.

Various other modifications will be apparent to those skilled in the art.

The invention claimed is:

1. An active matrix electroluminescent display device comprising an array of display pixels, each pixel comprising:

an electroluminescent (EL) display element (2);

a first amorphous silicon drive transistor ($T_{D1}$) for intermittently driving a current through the display element; and a second amorphous silicon drive transistor ($T_{D2}$) for intermittently driving a current through the display element, wherein said first transistor is driven during a first frame time with a voltage selected from a plurality of voltages representing a range data levels, and said second transistor is driven during a second frame time with a voltage selected from a plurality of voltages representing a range of data levels, the second frame time alternating with the first frame time, said first and second transistors being driven with a negative bias larger than required to turn off the corresponding transistor during the frame time when the transistor is not driving a current through the display element.

2. A device as claimed in claim 1, wherein the pixels are arranged in rows and columns, and wherein each drive transistor is associated with a respective column conductor (Data; Col1 , Col2).

3. A device as claimed in claim 1, wherein the light output from the display element (2) illuminates the first and second drive transistors ($T_{D1}$, $T_{D2}$).

4. A device as claimed in claim 1 comprising an active plate and electroluminescent material associated with the active plate.

5. A device as claimed in claim 4, wherein the active plate comprises a black mask layer (48) for shielding the pixel circuitry from the light of the display elements, and wherein the first and second drive transistors are not shielded by the black mask layer.

6. A device as claimed in claim 1, wherein each pixel comprises a first storage capacitor (C1) for storing a gate voltage for the first drive transistor ($T_{D1}$) and a second storage capacitor (C2) for storing a gate voltage for the second drive transistor ($T_{D1}$), a first address transistor for (A1) applying a data signal from a first data line (Col1)) to the first storage capacitor (C1) and a second address transistor (A2) for applying a data signal from a second data line (Col2) to the second storage capacitor (C2).

7. A device as claimed in claim 1, wherein each pixel further comprises a first capacitor arrangement comprising first and second capacitors ($C_1$, $C_2$) connected in series between the gate and source or drain of the first drive transistor ($T_{D1}$) and a second capacitor arrangement comprising first and second capacitors ($C_1$, $C_2$) connected in series between the gate and source or drain of the second drive transistor ($T_{D2}$), wherein a first data input (Data A) to the pixel is provided to the junction between the first and second capacitors of the first capacitor arrangement and a second data input (Data B) to the pixel is provided to the junction between the first and second capacitors of the second capacitor arrangement.

8. A device as claimed in claim 7, wherein each pixel further comprises a first input transistor ($A_1$) connected between a first input data line and the junction between the first and second capacitors of the first capacitor arrangement and a second input transistor ($B_1$) connected between a second input data line and the junction between the first and second capacitors of the second capacitor arrangement.

9. A device as claimed in claim 7, wherein the drain of each drive transistor is connected to a respective power supply line (Power A, Power B).

10. A device as claimed in claim 7, wherein each pixel further comprises a first threshold sampling transistor ($A_2$) connected between the gate and drain of the first drive transistor ($T_{D1}$) and a second threshold sampling transistor ($B_2$) connected between the gate and drain of the second drive transistor ($T_{D2}$).

11. A device as claimed in claim 7, wherein each pixel further comprises a first shorting transistor ($A_3$) connected between the junction between the first and second capacitors of the first capacitor arrangement and the display element (2) and a second shorting transistor ($B_3$) connected between the junction between the first and second capacitors of the second capacitor arrangement and the display element (2).

12. A device as claimed in claim 7, wherein each pixel further comprises a first bypass transistor connected between the first drive transistor source and a ground potential line and a second bypass transistor connected between the second drive transistor source and the ground potential line.

13. A device as claimed in claim 7, wherein the first and second capacitors ($C_1$, $C_2$) of the first and second capacitor arrangements are connected in series between the gate and drain of the respective drive transistor, and wherein the drain of each drive transistor is connected to a different respective power supply line (Power A, Power B), so that each drive transistor can be operated selectively to supply current to the display element or to provide a bypass path for current from the other drive transistor.

14. A device as claimed in claim 1, wherein each pixel further comprises a capacitor arrangement comprising first and second capacitors ($C_1$, $C_2$) connected in series between the gate of the first and second drive transistors ($T_{D1}$, $T_{D2}$) and a ground line, wherein the source of each drive transistor is connected to a respective control line (A, B), and wherein a data input (Data) to the pixel is provided to the junction between the first and second capacitors of the capacitor arrangement.

15. A device as claimed in claim 14, wherein each pixel further comprises a shorting transistor ($A_2$) connected across the terminals of the second capacitor.

16. A device as claimed in claim 14, wherein each pixel further comprises a charging transistor ($A_4$) connected between a power supply line and the drain of the first and second drive transistors.

17. A device as claimed in claim 14, wherein each pixel further comprises a discharging transistor ($A_3$) connected between the gates and drains of the first and second drive transistors.

18. A device as claimed in claim 1, wherein each drive transistor comprises an NMOS transistor.

19. A device as claimed in claim 1, wherein the electroluminescent (EL) display element comprises an electrophosphorescent organic electroluminescent display element.

20. A device as claimed in claim 1, wherein each pixel further comprises at least a third amorphous silicon drive transistor for intermittently driving a current through the display element.

21. A method of driving an active matrix electroluminescent display device (2), the method comprising:

driving current through an electroluminescent display element of a display pixel among a plurality of display pixels in the display device using first and second amorphous silicon drive transistors ($T_{D1}$, $T_{D2}$), wherein the first and second drive transistors are driven during alternate frame times, with a voltage selected from a plurality of voltages representing a range of data levels and wherein a drive transistor is driven with a negative bias larger than required to turn off the corresponding transistor when the transistor is not driving current through the display element (2).

22. A method as claimed in claim 21, wherein the drive transistors are illuminated by the display element (2).

23. A method as claimed in claim 21, further comprising compensating for variations over time of the threshold voltages of the first and second drive transistors.

24. A method as claimed in claim 23, wherein the step of compensating comprises:

driving a current through one of the drive transistors to ground, and charging a first capacitor to the resulting gate-source voltage;

discharging the first capacitor until the one drive transistor turns off, the first capacitor thereby storing a threshold voltage;

charging a second capacitor, in series with the first capacitor between the gate and source or drain of the drive transistor, to a data input voltage; and using the drive transistor to drive a current through the display element using a gate-source voltage or gate-drain voltage which comprises the combination of voltages across the first and second capacitors.

25. A method as claimed in claim 24, wherein the step of driving a current through one of the drive transistors to ground comprises driving the current through the other of the drive transistors to ground.

* * * * *